United States Patent [19]

Ziegler et al.

[11] 4,124,140

[45] Nov. 7, 1978

[54] GASKETED FLANGE SEALER

[75] Inventors: Michael J. Ziegler, East Brunswick, N.J.; Thomas D. Lee, Chattanooga, Tenn.

[73] Assignee: Allen-Stevens Corporation, Somerset, N.J.

[21] Appl. No.: 882,594

[22] Filed: Mar. 2, 1978

[51] Int. Cl.[2] ..... B65D 53/00

[52] U.S. Cl. ..... 220/304

[58] Field of Search ..... 220/288, 304; 285/204

[56] References Cited

U.S. PATENT DOCUMENTS

| | | | |
|---|---|---|---|
| 3,098,579 | 7/1963 | Wheaton | 220/304 |
| 3,405,837 | 4/1967 | Carpenter, Jr. | 220/288 X |

*Primary Examiner*—George T. Hall

*Attorney, Agent, or Firm*—Kirschstein, Kirschstein, Ottinger & Cobrin

[57] ABSTRACT

A closure for an opening in the surface of a drum or barrel, especially for a drum or barrel which has been reconditioned by heating so that the original gaskets have been burned out of the opening. The closure includes a cylindrical sleeve disposed in the opening and having a threaded inner surface. The threads of an externally threaded cylindrical cap engage the threads of the sleeve. The cap has an annular generally circular lip about its outer periphery and at its outer end, which lip extends perpendicularly to the sleeve adjacent the outer end of the sleeve so that the outer portion of the lip is parallel to the drum surface. A flexible resilient cylindrical gasket is coaxially mounted external to the sleeve so that the gasket lies between the lip and the drum surface. When the cap is screwed inwards into the sleeve, the lip compresses the gasket against the surface of the drum so that the gasket is squeezed and deforms, and thus so that the gasket forms a closure seal against fluid flow out of the drum.

15 Claims, 12 Drawing Figures

GASKETED FLANGE SEALER

BACKGROUND OF THE INVENTION

1. Field of the Invention

A closure for an opening such as a bunghole in a drum or barrel, especially for drums or barrels which have been reconditioned by heating.

2. Description of the Prior Art

The art of providing fluid-impervious closures for openings such as bungholes in a surface of a drum or barrel has taken new directions because of the current common practice of heating drums and barrels to high temperatures in order to recondition them for further usage, after an initial charge or filling of fluid has been removed and consumed. The high temperature treatment cleans the drum or barrel by burning out any residual fluid, however, the integral seals, originally present in the drum bunghole or other opening in the drum or barrel as manufactured, are also burned out, and thus the bunghole is susceptible to leakage unless a new closure is provided to effect a fluid-impervious seal.

A variety of relatively complex reconditioning structures have been suggested for drum or barrel closures, e.g. U.S. Pat. No. 3,098,579.

SUMMARY OF THE INVENTION

Purposes of the Invention

It is an object of the present invention to provide an improved closure for an opening in a surface of a drum.

Another object is to provide an improved closure for a bunghole.

A further object is to provide an improved closure for a bunghole in a drum which has been reconditioned by heating.

An additional object is to provide an improved fluid-impervious closure for a bunghole in a drum.

Still another object is to provide an inexpensive and readily installed closure for an opening in a surface of a drum.

An object is to render reconditioned drums serviceable for further transport of fluids in a simple and inexpensive manner.

An object is to provide improved and inexpensive elements of structure for effecting the fluid-impervious closure of an opening in a surface of a drum.

These and other objects and advantages of the present invention will become evident from the description which follows.

Brief Description of the Invention

Within the context of the present invention, the term drum will be understood to encompass and include not only drums per se such as steel drums, but also barrels, kegs, containers and vessels of various configurations, tanks, etc. In addition, the improved closure is primarily intended for usage with reconditioned drums, however, it will be understood that the present invention is also amenable for application as original equipment on new drums.

In the present invention, the improved closure for an opening in a surface of a drum basically includes a cylindrical sleeve, a cylindrical cap, and a cylindrical gasket, which three elements are generally oriented coaxially in a concentric arrangement. The improved closure thus generally entails the provision of a cylindrical sleeve having a threaded inner surface. The sleeve is mounted in and is coaxial with the opening in the drum surface. The cylindrical cap is externally threaded; the threads of the cap engage the threads of the sleeve.

The cap has an annular circular lip about its outer periphery; this lip is disposed at the outer end of the cap i.e. the end of the cap spaced away from the drum. The lip extends generally perpendicularly to the sleeve adjacent the outer end of the sleeve, so that the outer portion of the lip is parallel to the drum surface. The flexible resilient cylindrical gasket is coaxial with the cap and sleeve and is concentrically disposed external to the sleeve. Thus the gasket lies between the lip and the drum surface, so that when the cap is manually screwed inwards into the sleeve, the lip compresses the gasket against the surface of the drum so that the gasket is squeezed and deforms, and thus so that the gasket forms a fluid-impervious closure seal against fluid flow out of the drum.

In a preferred embodiment, a rigid cylindrical constraining ring is provided external to the gasket to hold the gasket in place and prevent the gasket from bowing outwards, thus the proper deforming of the gasket and positive uniform complete contact of the ends of the gasket with, respectively, the lip and the drum surface, is attained, when the cap is screwed into the sleeve. Either or both of the outer and inner edges of the ring are preferably flared outwards away from the gasket. Flaring of the outer edge of the ring, i.e. the edge spaced away from the drum, expedites crimping of a closure cap or capseal by providing a seat to take the crimped edge of the capseal. The flaring of the inner edge of the ring strengthens the ring. The ring may be composed of a metal such as steel, aluminum or brass, or of a plastic such as bakelite, methyl methacrylate, polyethylene, polypropylene, polyvinyl chloride etc.

In another embodiment of the invention, the outer surface of the gasket is notched, so that the gasket deforms inwards when compressed. In other words, a circumferential groove is provided on the extreme or outer surface of the gasket to encourage a constrictive buckling of the gasket when subjected to columnar pressure in the absence of a constraining ring.

It is preferred that the opening in the drum surface be defined by a cylindrical collar which extends outwards generally perpendicularly to the surface of the drum and which is concentrically disposed between the sleeve and the gasket. In this embodiment of the invention, typically the sleeve is provided with a curved outer extension which curves outwards and about the outer edge of the collar, so that the concave surface of the outer extension is contiguous with the outer edge of the collar. In addition, when a collar is provided, it is preferred that the sleeve be provided with an inner extension consisting generally of a flange or flange-like element which extends outwards generally perpendicularly from the inner end of the sleeve and extends into and is juxtaposed with a shoulder in the surface of the drum. The shoulder is concentrically disposed about the inner end of the collar, i.e. the end of the collar closest to the drum.

The annular circular lip preferably has a hexagonal periphery to accommodate a standard wrench which may be used to tighten the cap in the sleeve. A transverse raised handle may be provided on the cap so that the cap is manually rotatable.

The flexible resilient gasket is preferably composed of an elastomeric material such as natural rubber, neoprene, buna or hypalon.

In a preferred embodiment, when a capseal is provided, a rigid cylindrical constraining ring is provided external to the gasket. The outer edge of the ring is flared outwards away from the gasket. The capseal which is provided extends over the cap and about the outer edge of the ring. The annular portion of the capseal is disposed over the outer edge of the ring and is crimped on, so that the capseal acts as a seal between the cap and the ring.

The present closure provides several salient advantages. The improved closure is cheap, simple and readily manufactured, while still attaining effective sealing against fluid flow through or about the opening in the surface of a drum. The closure enables reconditioned drums to have a further useful life. Bungholes in drums are effectively sealed in a fluid-impervious manner. The closure is inexpensive and is readily installed. Reconditioned drums are rendered serviceable for further transport of fluids in a simple and inexpensive manner. Improved and inexpensive elements of structure are provided for effecting the fluid-impervious closure of an opening in a surface of a drum. Thus, an improved closure for a bunghole in a drum is provided.

The invention accordingly consists in the features of construction, combination of elements and arrangement of parts, which will be exemplified in the article of manufacture hereinafter described and of which the scope of application will be indicated in the appended claims.

BRIEF DESCRIPTION OF THE DRAWINGS

In the accompanying drawings in which are shown several of the various possible embodiments of the invention.

DETAILED DESCRIPTION OF THE PREFERRED EMBODIMENTS

Figure 1:
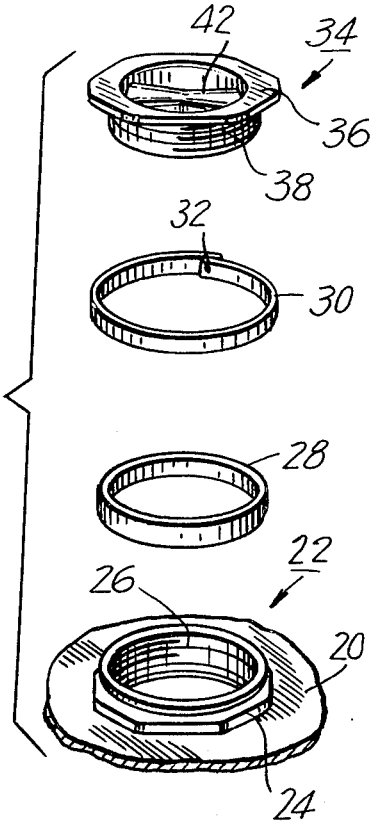
FIG. 1 is an exploded perspective view of one embodiment of the invention.
Figure 2:
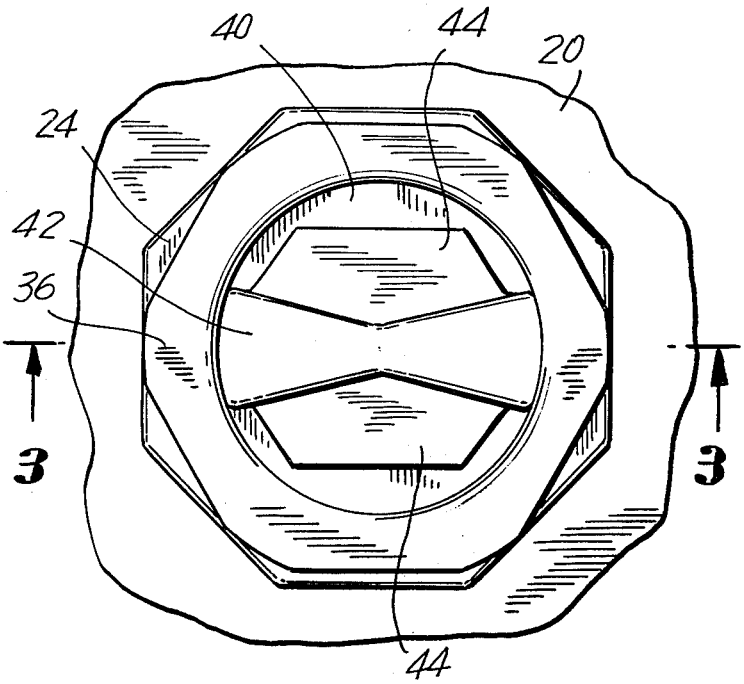
FIG. 2 is a plan view of the assembled closure of FIG. 1.

Referring now to FIGS. 1 and 2, the closure is applied to an opening in a surface 20 of a drum. The circular opening 22 is defined by a peripheral shoulder 24 having an octagonal outer edge, and an internally threaded cylindrical sleeve 26. The closure in this embodiment includes a flexible resilient gasket 28 which is of generally flat cylindrical configuration prior to compression (FIG. 1), a rigid cylindrical constraining ring 30 formed by attaching the ends of a strip of metal such as steel as shown at 32, and an externally threaded cylindrical cap 34. The cap 34 has an annular generally circular lip 36 about its outer periphery and at its outer end. The lip 36 has a generally hexagonal outer periphery to accommodate a standard wrench. An outwardly threaded cylindrical portion 38 of the cap 34 depends from the lip 36 to a lower disc-shaped flat section 40 of the cap 34. The section 40 has a circular perimeter at its junction with the section 38. A transverse rectilinear handle 42 is provided above section 40 so that the cap 34 may be manually rotated about its central axis. Plate 44 is a flat stiffening member which joins handle 42 to section 40 and distributes the stress during tightening evenly about the periphery of the cap 34.

Figure 3:
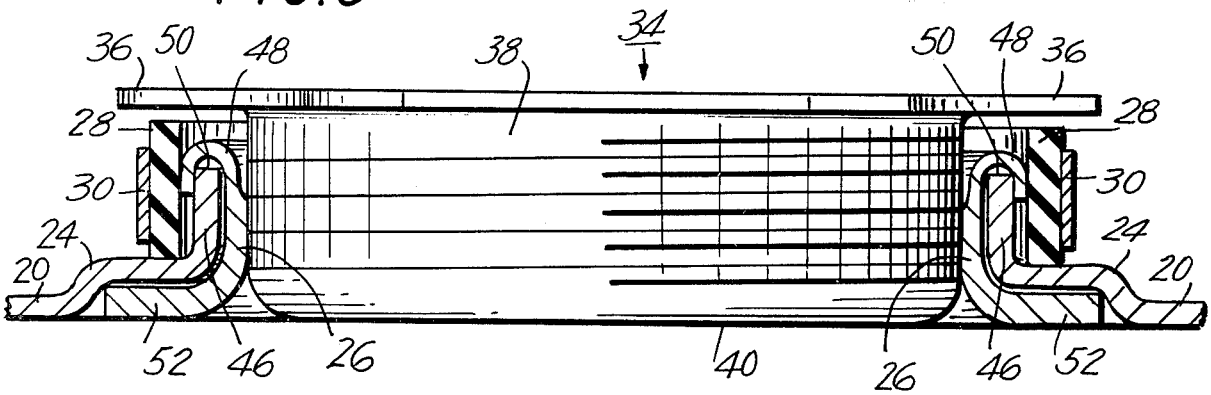
FIG. 3 is a sectional elevation view taken substantially along the line 3—3 of FIG. 2 and showing the disposition of the elements prior to the screwing of the cap downwards into the sleeve to effect closure sealing.

Referring now to FIG. 3, the disposition of the various elements prior to the screwing of the cap 34 downwards to effect closure sealing is shown. The sleeve 26 is mounted on a collar 46, which collar 46 is cylindrical and extends perpendicularly from the surface 20 (shoulder 24), so that the elements 26, 46, 28 and 30 are coaxially and concentrically oriented. The sleeve 26 is attached to the collar 46 by means of the provision of an upper curved outer extension 48 which curves outwards from sleeve 26 and about the outer edge 50 of the collar, so that the concave surface of the outer extension 48 is contiguous with the outer edge 50 of the collar 46. The sleeve 26 is provided with an inner extension 52 consisting generally of a flange or flange-like element which extends outwards generally perpendicularly from the inner end of the sleeve 26. Flange extension 52 extends into and is juxtaposed with the shoulder 24 in the surface 20 of the drum.

Figure 4:
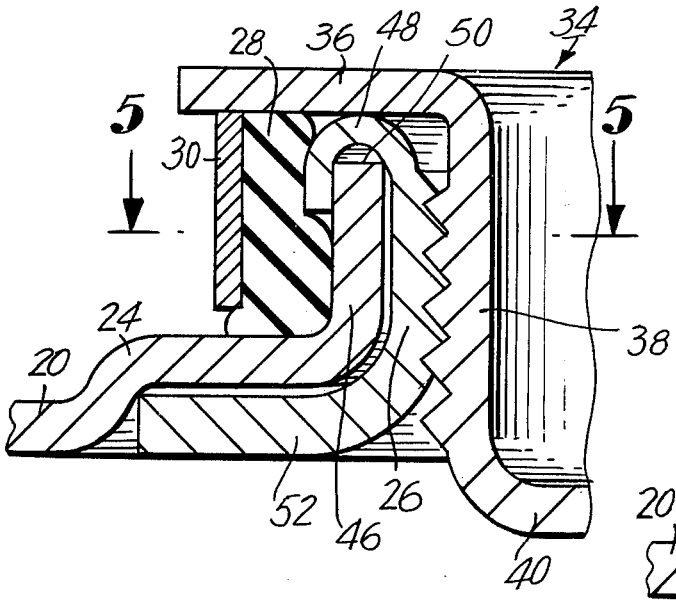
FIG. 4 is a partial sectional elevation view of one side of the closure of FIG. 3, showing the disposition of elements when fluid-impervious sealing is effected.
Figure 5:
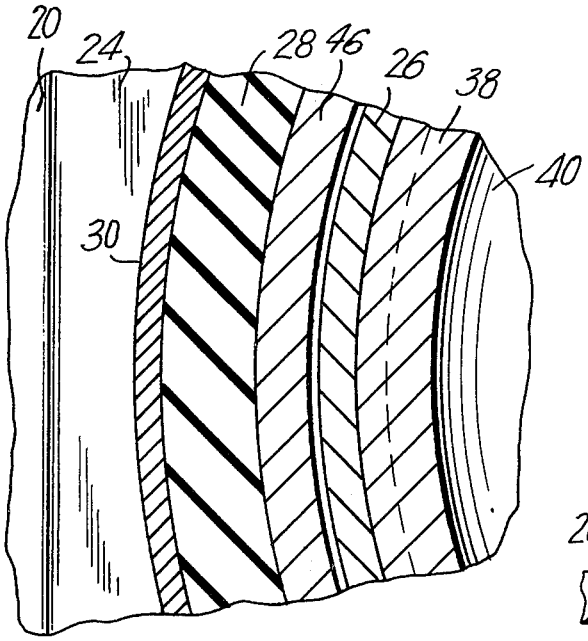
FIG. 5 is a partial sectional plan view taken substantially along the line 5—5 of FIG. 4.

As shown in FIG. 3, prior to the downwards (inwards) screwing of cap 34, the lip 36 is spaced from the gasket 28, and this gasket 28 is of cylindrical configuration with a rectangular cross-section. As shown in FIG. 4, after the cap 34 has been screwed downwards into the sleeve, the gasket 28 is deformed top and bottom so that a fluid-impervious closure seal against fluid flow has been effected. The presence of the constraining ring 30 serves to inhibit any outwards lateral movement of the gasket 28, so that the deformable gasket 28 is effectively squeezed downwards into a configuration such that a closure seal against lip 36 on the top and against collar 46 and shoulder 24 on the bottom is attained. FIG. 5 shows the concentric disposition of the several elements in the assemblage, in partial circular cross-section.

Figure 6:
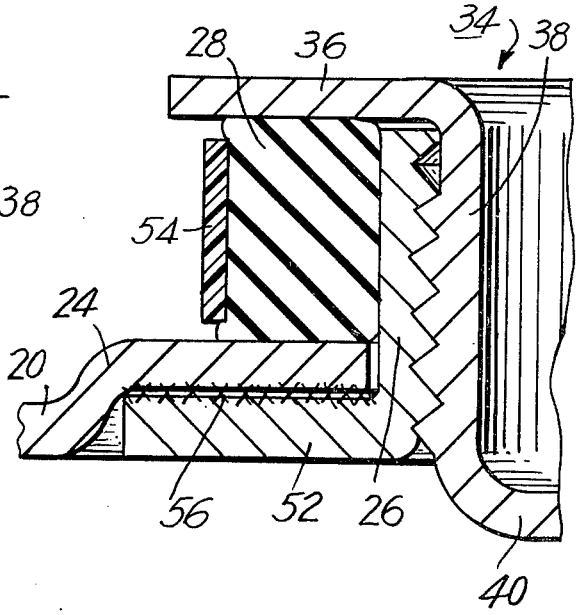
FIG. 6 is a partial sectional elevation view of one side of an alternative embodiment of the present closure.

FIG. 6 shows a configuration in which a closure seal has been effected by the provision of a constraining ring 54 composed of a rigid plastic such as one of those plastics mentioned supra. In addition, FIG. 6 shows an alternative method of screwing the collar 46 to the drum, namely by welding flange extension 52 to shoulder 24 via welding joint 56. FIG. 6 also illustrates a relatively thicker gasket 28 and a centralized orientation of the ring 54 which is equally spaced from the lip 36 and the shoulder 24. FIG. 6 also shows an arrangement in which a mounting collar is absent.

Figure 7:
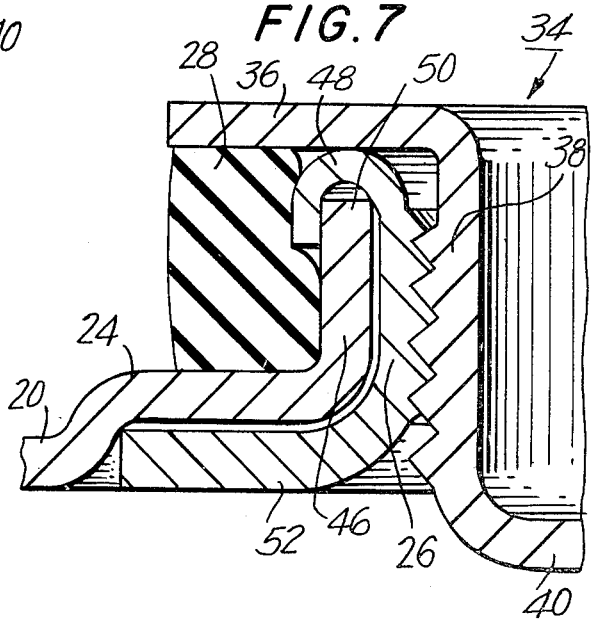
FIG. 7 is a partial sectional elevation view of one side of another alternative embodiment of the present closure.

FIG. 7 shows a thick gasket 28 without a constraining ring. The gasket 28 has bowed outwards slightly, however top and bottom sealing has been effected due to the thickness of gasket 28 and consequent relatively extensive top and bottom contact surfaces between, respectively, gasket 28 and lip 36, and gasket 28 and shoulder 24.

Figure 8:
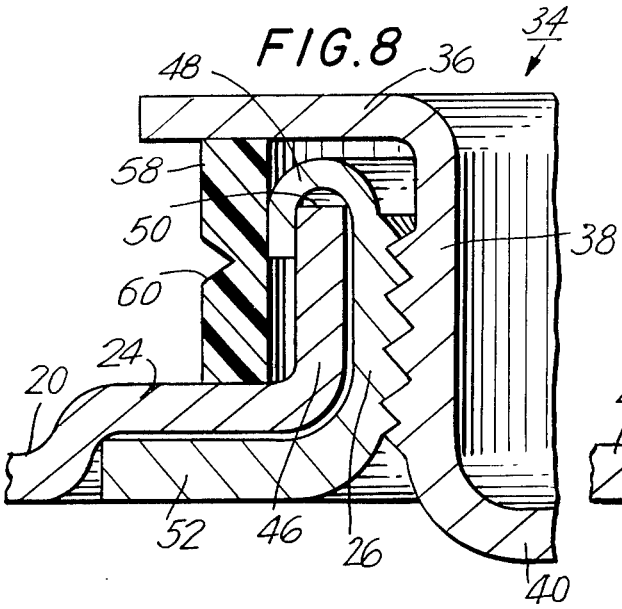
FIG. 8 is a partial sectional elevation view of one side of still another alternative embodiment of the present closure, showing the disposition of the elements prior to the effecting of sealing.
Figure 9:
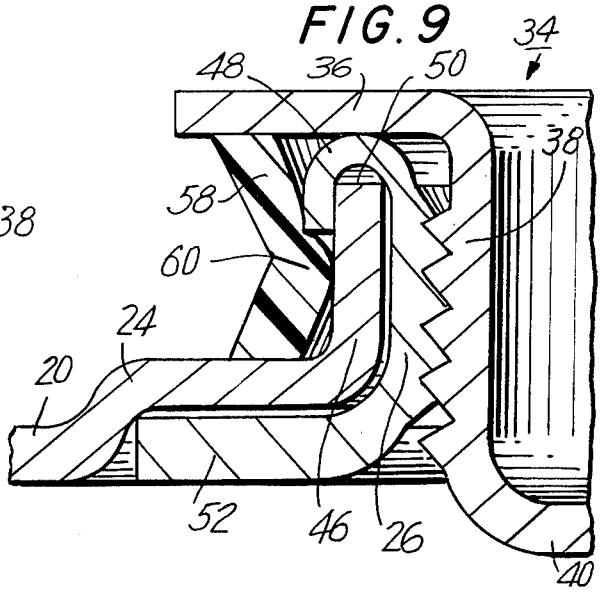
FIG. 9 shows the orientation of the elements of FIG. 8 after the cap has been screwed down into the sleeve and sealing has been effected.

FIGS. 8 and 9 show a notched gasket 58, in, respectively, the uncompressed state prior to the screwing downwards of the cap 34, and the compressed state in which fluid-impervious closure sealing has been effected by screwing cap 34 downwards into sleeve 26. The notch 60 on the outer periphery of gasket 58 insures that the gasket 58 will buckle inwards under compression and thereby effect closure sealing.

Figure 10:
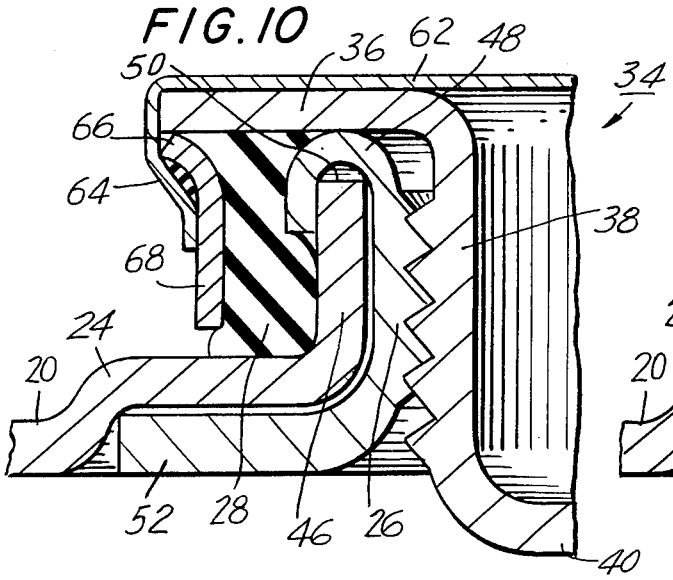
FIG. 10 is a partial sectional elevation view of one side of still another alternative embodiment of the present closure.

FIG. 10 shows a capseal 62 which has been crimped at 64 onto the outwardly flared upper end 66 of a restraining and constraining ring 68. Sealing against fluid leakage is thus attained not only by top and bottom contact of the gasket 28 with, respectively, members 36 and 24, but also by the crimping on of the capseal 62 at 64 against the outwardly flared and curved surface 66.

Figure 11:
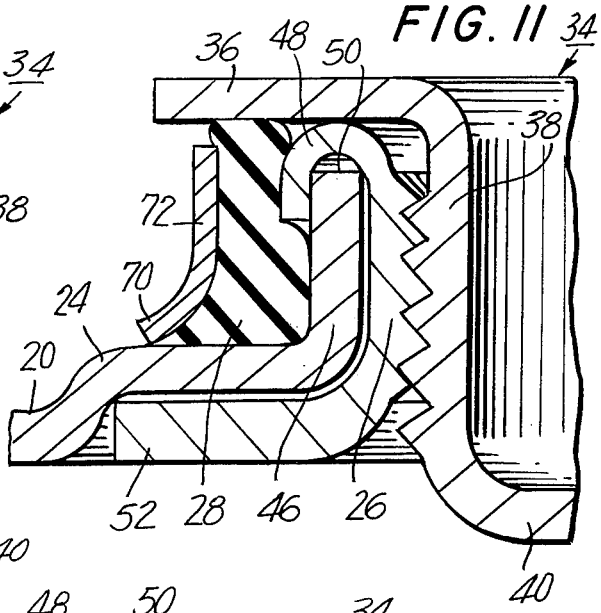
FIG. 11 is a partial sectional elevation view of one side of another alternative embodiment of the present closure.
Figure 12:
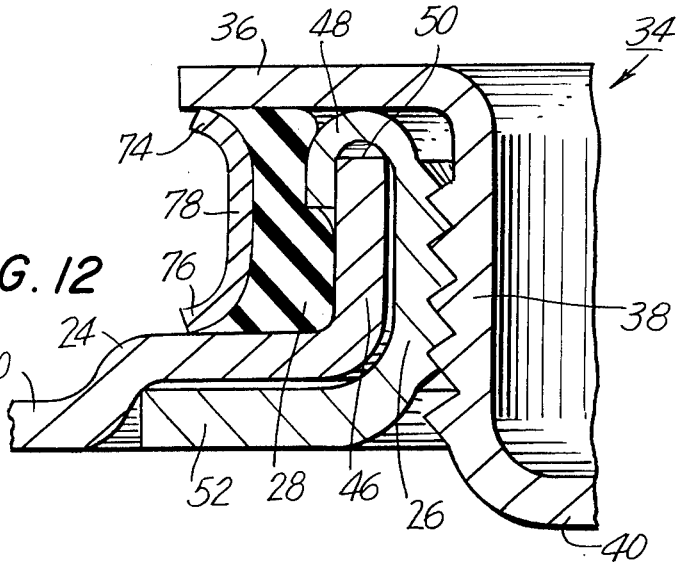
FIG. 12 is a partial sectional elevation view of one side of a further alternative embodiment of the present closure.

FIG. 11 shows outward flaring at 70 of the lower or inner end of a constraining ring 72, while FIG. 12 shows outward curved flaring of both the top and bottom, or respectively, the outer and inner ends 74 and 76, of a constraining ring 78.

It thus will be seen that there is provided a closure for an opening in a surface of a reconditioned drum which achieves the various objects of the invention and which is well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limited sense. Thus, it will be understood by those skilled in the art that although preferred and alternative embodiments have been shown and described in accordance with the Patent Statutes, the invention is not limited thereto or thereby.

Having thus described the invention, there is claimed as new and desired to be secured by Letters Patent:

1. A closure for an opening in a surface of a drum, said closure comprising a cylindrical sleeve, said sleeve being mounted in and being coaxial with the opening in the drum surface, the inner surface of said sleeve being threaded, an externally threaded cylindrical cap, the threads of said cap engaging the threads of said sleeve, said cap having an annular circular lip at the outer end thereof about its outer periphery, said lip extending substantially perpendicularly to said sleeve adjacent the outer end of said sleeve, an outer portion of said lip being parallel to the drum surface, and a flexible resilient cylindrical gasket, said gasket being coaxial with said cap and sleeve and being located externally to said sleeve, said gasket lying between said lip and the drum surface, so that when said cap is screwed inwards into said sleeve, said lip compresses said gasket against the surface of the drum so that said gasket forms a closure seal against fluid flow out of said drum.

2. The closure of claim 1 in which a rigid constraining ring is provided external to the gasket.

3. The closure of claim 2 in which the ring is cylindrical.

4. The closure of claim 3 in which the outer edge of the ring is flared outwards away from the gasket.

5. The closure of claim 3 in which the inner edge of the ring is flared outwards away from the gasket.

6. The closure of claim 3 in which both the outer and inner edges of the ring are flared outwards away from the gasket.

7. The closure of claim 2 in which the ring is composed of a metal or a plastic.

8. The closure of claim 1 in which the outer surface of the gasket is notched.

9. The closure of claim 1 in which the opening in the drum surface is defined by a cylindrical collar, said collar extending outwards substantially perpendicularly to the surface of the drum, said collar being concentrically disposed between the sleeve and the gasket.

10. The closure of claim 9 in which the sleeve is provided with a curved outer extension, said outer extension curving outwards and about the outer edge of the collar so that the concave surface of said outer extension is contiguous with the outer edge of the collar.

11. The closure of claim 9 in which the sleeve is provided with an inner extension, said inner extension comprising a flange, said flange extending outwards substantially perpendicularly from the inner end of the sleeve and extending into and being juxtaposed with a shoulder in the surface of the drum, said shoulder being concentrically disposed about the inner end of the collar.

12. The closure of claim 1 in which the annular circular lip has a hexagonal periphery.

13. The closure of claim 1 in which a transverse raised handle is provided on the cap so that the cap is manually rotatable.

14. The closure of claim 1 in which the gasket is composed of an elastomeric material selected from the group consisting of natural rubber, neoprene, buna and hypalon.

15. The closure of claim 1 in which a rigid cylindrical constraining ring is provided external to the gasket, the outer edge of said ring being flared outwards away from the gasket, together with a capseal, said capseal extending over the cap and about the outer edge of said ring, the annular portion of said capseal disposed over the outer edge of said ring being crimped on so that said capseal acts as a seal between the cap and said ring.

* * * * *